US008297236B2

(12) United States Patent
Franke et al.

(10) Patent No.: US 8,297,236 B2
(45) Date of Patent: Oct. 30, 2012

(54) STEAM GENERATOR

(75) Inventors: Joachim Franke, Altdorf (DE); Rudolf Kral, Stulin (DE)

(73) Assignee: Siemens Aktiengesellschaft, München (DE)

( * ) Notice: Subject to any disclaimer, the term of this patent is extended or adjusted under 35 U.S.C. 154(b) by 1016 days.

(21) Appl. No.: 11/887,859

(22) PCT Filed: Mar. 31, 2006

(86) PCT No.: PCT/EP2006/061225

§ 371 (c)(1),
(2), (4) Date: Nov. 18, 2008

(87) PCT Pub. No.: WO2006/106079

PCT Pub. Date: Oct. 12, 2006

(65) Prior Publication Data

US 2009/0071419 A1 Mar. 19, 2009

(30) Foreign Application Priority Data

Apr. 5, 2005 (EP) ..... 05007413

(51) Int. Cl.
*F22B 37/26* (2006.01)

(52) U.S. Cl. ..... 122/1 B; 122/406.1; 122/406.4; 122/488; 122/489

(58) Field of Classification Search ..... 122/1 B, 122/32, 406.4, 451 S, 448.4, 406.1, 406.2, 122/406.3, 488, 489
See application file for complete search history.

(56) References Cited

U.S. PATENT DOCUMENTS

| | | | | |
|---|---|---|---|---|
| 3,369,526 | A | 2/1968 | Midtlyng | |
| 3,592,170 | A * | 7/1971 | Burkle | 122/406.4 |
| 3,719,172 | A * | 3/1973 | Charcharos et al. | 122/7 R |
| 3,789,806 | A | 2/1974 | Gorzegno | |
| 4,194,468 | A * | 3/1980 | Augsburger | 122/406.5 |
| 5,293,842 | A * | 3/1994 | Loesel | 122/7 R |
| 5,588,400 | A * | 12/1996 | Stefan et al. | 122/406.1 |
| 5,765,509 | A * | 6/1998 | Liebig et al. | 122/7 R |
| 5,924,389 | A * | 7/1999 | Palkes et al. | 122/7 R |
| 5,976,207 | A * | 11/1999 | Vollmer | 55/309 |
| 6,173,679 | B1 * | 1/2001 | Bruckner et al. | 122/406.4 |
| 6,192,837 | B1 * | 2/2001 | Wittchow | 122/406.4 |
| 6,408,800 | B2 * | 6/2002 | Schmidt et al. | 122/488 |
| 7,555,890 | B2 * | 7/2009 | Kurihara et al. | 60/39.182 |
| 7,628,124 | B2 * | 12/2009 | Bruckner et al. | 122/470 |

FOREIGN PATENT DOCUMENTS

| | | | |
|---|---|---|---|
| DE | 4242144 | A1 | 6/1994 |
| EP | 0777035 | A1 | 6/1997 |
| GB | 691324 | | 5/1953 |
| JP | 59124803 | A | 7/1984 |
| JP | 2000506441 | | 5/2000 |
| SU | 311087 | | 10/1971 |

* cited by examiner

*Primary Examiner* — Gregory A Wilson

(57) ABSTRACT

The invention relates to a steam generator wherein a continuous heating panel of a generator, which is formed from a number of evaporator tubes, and an overheating panel, which is formed from a number of over-heating tubes which are arranged downstream from the evaporator tubes and on the flow side, are arranged in a heating gas channel. According to the invention, a water separating element is integrated into a number of over-flow tubes which are connected on the flow side of one of several evaporator tubes to one or several overheating tubes.

9 Claims, 3 Drawing Sheets

STEAM GENERATOR

CROSS REFERENCE TO RELATED APPLICATIONS

This application is the US National Stage of International Application No. PCT/EP2006/061225, filed Mar. 31, 2006 and claims the benefit thereof. The International Application claims the benefits of European application No. 05007413.7 filed Apr. 5, 2005, both of the applications are incorporated by reference herein in their entirety.

FIELD OF INVENTION

The invention relates to a steam generator, in which an evaporator once-through heating surface, formed from a number of evaporator tubes, and a superheater heating surface, formed from a number of superheater tubes connected downstream of the evaporator tubes on the flow medium side, are arranged in a heating gas passage.

BACKGROUND OF THE INVENTION

In a once-through steam generator, the heating of a number of evaporator tubes leads to complete evaporation of the flow medium in the evaporator tubes in one pass. The flow medium—usually water—, after it has been evaporated, is fed to superheater tubes connected downstream of the evaporator tubes and is superheated there. The position of the evaporation end point, i.e. the boundary region between unevaporated and evaporated flow medium, is in this case variable and dependent on operating mode. During full-load operation of a once-through steam generator of this time, the evaporation end point is, for example, in an end region of the evaporator tubes, so that the superheating of the evaporated flow medium begins as early as in the evaporator tubes. A once-through steam generator, unlike a natural or forced circulation steam generator, is not subject to any pressure restrictions, and consequently it can be designed for live steam pressures well above the critical pressure of water ($P^{Cri}\approx 221$ bar), where it is not possible to distinguish between the water and steam phases and therefore phase separation is also not possible.

Once-through steam generators of this type can be used in gas and steam turbine installations, in which the heat contained in the expanded working medium or heating gas from the gas turbine is utilized to generate steam for the steam turbine. Use may be envisaged in particular in combination with what is known as an industrial gas turbine with a rated power of up to approximately 60 MW. With concepts of this type, in view of the boundary conditions which are predetermined by the nominal power, it is possible to provide for the preheating and evaporation of the water and the further superheating of the steam which is generated in a single once-through heating surface, the tubes of which are connected on the inlet side to entry manifolds for the supercooled feedwater and on the outlet side to exit manifolds for the superheated steam.

In low-load operation or when starting up a once-through steam generator of this type, the hot exhaust gas from the gas turbine is usually first of all passed to the uncooled tubes of the superheater section of the once-through steam generator, which for this reason usually have to be made from high-quality thermally stable materials. Alternatively, it is also possible for the evaporator section to be fed with a minimum flow of flow medium in order to ensure reliable cooling of the steam generator tubes. In particular at low loads of, for example, less than 40% of the design load, the once-through mass flow through the steam generator tubes corresponding to the associated steam power is usually no longer sufficient to cool these tubes, and consequently an additional throughput of flow medium is superimposed on this once-through passage of flow medium through the evaporator. In this case, separation of water out of the flow medium is usually required before the flow medium enters the superheater section of the once-through steam generator. For this purpose, the once-through heating surface in its entirety may be formed by an evaporator once-through heating surface, which is arranged in a heating gas passage and is formed from a number of evaporator tubes, and by a superheater heating surface, which is connected downstream of the evaporator once-through heating surface on the flow medium side and is formed from a number of superheater tubes, a water separation system being connected between the evaporator once-through heating surface and the superheater heating surface on the flow medium side.

In once-through steam generators of this type, the evaporator tubes which form the evaporator section usually open out into one or more exit manifolds, from which the flow medium is passed into a downstream water-steam separator, where the flow medium is separated into water and steam, the steam being transferred into a distributor system connected upstream of the superheater tubes, where the steam mass flow is divided between the individual superheater tubes connected in parallel on the flow medium side.

In a design of this type, the intervening connection of the water separation system means that in start-up and low-load operation the evaporation end point of the once-through steam generator is fixed rather than—as in the case of full-load operation—variable. Consequently, the operating flexibility of this type of design of once-through steam generator is considerably restricted in low-load operation. Furthermore, in a design of this type, the separation systems generally have to be designed, in particular with regard to the choice of materials, to ensure that the steam in the separator is significantly superheated in pure once-through operation. The required choice of materials likewise leads to considerable restrictions in operating flexibility. With regard to the dimensioning and construction of the components required, moreover, the abovementioned design means that the water discharge which occurs in the initial start-up phase when the once-through stream generator is being started up, has to be entirely dealt with by the separation system and discharged into the expander via the downstream separation cylinder and the outlet valves. The resulting relatively large dimension of separation cylinder and outlet valves leads to considerable production and assembly costs.

SUMMARY OF INVENTION

Therefore, the invention is based on the object of providing a steam generator of the type described above which, with relatively low production and assembly costs, has a particularly high operating flexibility even when starting up and in low-load operation.

According to the invention, this object is achieved by virtue of a water separation element in each case being integrated in a number of overflow tube sections which in each case connect one or more evaporator tubes to in each case one or more superheater tubes on the flow medium side.

In this context, the invention is based on the consideration that the once-through steam generator should be designed to ensure a particularly high operating flexibility even in start-up or low-load operation for a variable evaporation end point. For this purpose, the design-related fixing of the evaporation end point in the water separation system, which has been customary in previous systems, should be avoided. Based on the knowledge that this fixing is substantially caused by the collection of the flow medium flowing out of the evaporator tubes, the subsequent water separation in a central water separation device and the subsequent distribution of the steam between the superheater tubes, the water separation function needs to be decentralized. The water separation should in particular be designed in such a manner that after the water separation the distribution of the flow medium is not too complex, since in particular this complexity is not practicable for a water-steam mixture. This can be achieved by the water separation system being of decentralized design, deviating from the central water-steam separation that has hitherto been customary, with the water separation now being integrated in tube sections which are in any case required to connect the evaporator tubes to the downstream superheater tubes on the flow medium side.

The once-through steam generator can be of vertical or horizontal design. Therefore, the heating gas passage can be designed for the heating gas to flow through it in a substantially vertical direction of flow or in a substantially horizontal direction of flow.

One particularly simple design of the water separation elements with a high level of water separation reliability can be achieved by the respective water separation element advantageously being designed for inertial separation of the water from the steam in the flow medium. For this purpose, it is preferable to exploit the knowledge that the water content of the flow medium, on account of its higher inertia than the steam content, preferentially continues to flow straight on in terms of its direction of flow, whereas the steam content in relative terms is better able to follow an imposed diversion. To utilize this effect with a high separation action for a relatively simple design of water separation element, the latter is designed in the form of a T-piece in a particularly advantageous configuration. In this case, the respective water separation element preferably comprises an inflow tube section, which is connected to the evaporator tube connected upstream and which, as seen in its longitudinal direction, merges into a water discharge tube section, a number of outflow tube sections, which are connected to a superheater tube in each case connected downstream, branching off in the transition region. The water content of the flow medium flowing into the inflow tube section, on account of its in relative terms higher inertia, is transported onwards in the longitudinal direction at the branching location substantially without being diverted and therefore passes into the water discharge section. By contrast, on account of its in relative terms lower inertia, it is easier to divert the steam fraction, with the result that the steam fraction passes into the outflow tube section(s) branching off.

It is preferable for the inflow tube section to be of substantially rectilinear design, in which case it may be arranged with its longitudinal direction substantially horizontal or at a predetermined angle of inclination or tilt. A downward inclination in the direction of flow is preferable in this context. Alternatively, it is possible for medium to flow to the inflow tube section via a tube bend arriving from above, so that in this case the flow medium is forced toward the outer side of the curvature as a result of centrifugal force. As a result, the water fraction of the flow medium preferentially flows along the outer region of the curvature. In this configuration, therefore, the outflow tube section intended to carry away the steam fraction is preferably oriented toward the inner side of the curvature.

The water discharge tube section, in its entry region, is preferably designed as a downwardly curved tube bend. This facilitates diversion of the water which has been separated off to be fed into subsequent systems as required in a particularly simple and low-loss way.

On the water outlet side, i.e. in particular by means of their water discharge tube sections, the water separation elements are advantageously connected in groups to a number of common exit manifolds. With this type of connection, therefore, unlike in conventional systems, in which the water separator is connected downstream of the exit manifolds of the evaporator tubes on the flow medium side, the respective water separation element is now connected upstream of the exit manifold. In particular this measure allows flow medium to be transferred direct from the evaporator tubes to the superheater tubes without the intermediate connection of collection or distribution systems even in start-up or low-load operation, so that the evaporation end point can also be shifted into the superheater tubes. In this case, a number of water collection vessels are advantageously connected downstream of the exit manifolds. The water collection vessel(s) may for their part be connected on the outlet side to suitable systems, such as for example an atmospheric expander or, via a recirculation pump, to the recirculation circuit of the once-through steam generator.

During the separation of water and steam in the water separation system, it is possible to separate out either virtually the entire water content, so that only flow medium which is still in evaporated form is passed on to the superheater tubes connected downstream; in this case, the evaporation end point is still in the evaporator tubes. Alternatively it is possible for only some of the water produced to be separated out, in which case the remaining flow medium which is in unevaporated form is passed on together with the evaporated flow medium into the downstream superheater tubes; in this case, the evaporation end point shifts into the superheater tubes.

In the latter case, also referred to as over-feeding of the separation device, the components connected downstream of the water separation elements on the water side, such as for example exit manifold or water collection vessel, are first of all completely filled with water, with the result that a build-up of water starts to form in the corresponding line sections as water continues to flow in. As soon as this build-up of water has reached the water separation elements, at least a part-stream of water which is newly flowing is passed on to the subsequent superheater tubes together with the steam entrained in the flow medium. To ensure a particularly high operating flexibility in this operating mode of what is known as over-feeding of the separation system, in a particularly advantageous configuration a control valve, which can be actuated by means of an associated regulating device, is connected into an outflow line connected to the water collection vessel. An input value which is characteristic of the enthalpy of the flow medium at the exit of the superheater heating surface can advantageously be supplied to the regulating device.

In the operating mode of the over-fed separation system, a system of this type, by targeted actuation of the valve connected into the outflow line of the water collection vessel, can be used to set the mass flow flowing out of the water collection vessel. Since this mass flow is replaced by a corresponding mass flow of water from the water separation elements, therefore, it is also possible to set the mass flow which passes from the water separation elements into the collection system. Therefore, it is once again possible to set the part-stream which is transferred into the superheater tubes together with the steam, so that by suitable setting of this part-stream a predetermined enthalpy can be maintained for example at the end of the superheater section of the once-through heating surface. As an alternative or in addition, the water part-stream which is passed on to the superheater tubes together with the steam can also be influenced by corresponding control of the higher-level recirculation circuit. For this purpose, in a further or alternative advantageous configuration, a recirculation pump assigned to the evaporator tubes can be actuated by the regulating device assigned to the water separation system.

It is expedient for the steam generator to be used as a heat recovery steam generator of a combined-cycle gas and steam turbine installation.

The advantages achieved by the invention are in particular that as a result of the water separation being integrated in the tube system of the steam generator, the water separation can be effected without prior collection of the flow medium flowing out of the evaporator tubes and without subsequent distribution of the flow medium passed on to the superheater tubes. Consequently, it is possible to avoid the need for complex collection and distribution systems. Furthermore, the elimination of complex distribution systems means that the transfer of flow medium to the superheater tubes is not restricted to steam alone; rather, it is now also possible for a water-steam mixture to be passed on to the superheater tubes. In particular as a result, the evaporation end point can be shifted beyond the location of separation between evaporator tubes and superheater tubes, if necessary into the superheater tubes themselves. This allows a particularly high degree of operating flexibility to be achieved even in start-up or low-load operation of the once-through stream generator.

Furthermore, the water separation elements may in particular also be designed as T-pieces based on the piping of the once-through steam generator which is already present in any case. These T-pieces can be of relatively thin-walled design, in which case diameter and wall thickness can be kept approximately equal to those of the wall tubes. Therefore, the thin-walled design of the water separation elements means that the start-up times of the boiler as a whole or also the load change speeds are not limited any further, so that relatively short reaction times in the event of load changes can be achieved even in installations for high stream states. Moreover, T-pieces of this type can be produced at particularly low cost. In particular, even temporary over-feeding of the separation elements when starting up or in low-load operation is permissible, so that some of the evaporator water which is to be discharged can be collected in the superheater tubes connected downstream of the evaporator tubes. This allows the water collection systems, such as for example the separation cylinders or the outlet valves, to be designed for correspondingly smaller outlet quantities, making them less expensive. Furthermore, the shift in the evaporation end point into the superheater tubes makes it possible to limit any water injection which may be required, with the associated losses.

BRIEF DESCRIPTION OF THE DRAWINGS

An exemplary embodiment of the invention is explained in more detail with reference to a drawing, in which.

Identical parts are denoted by the same reference designations throughout all the figures.

DETAILED DESCRIPTION OF INVENTION

Figure 1:
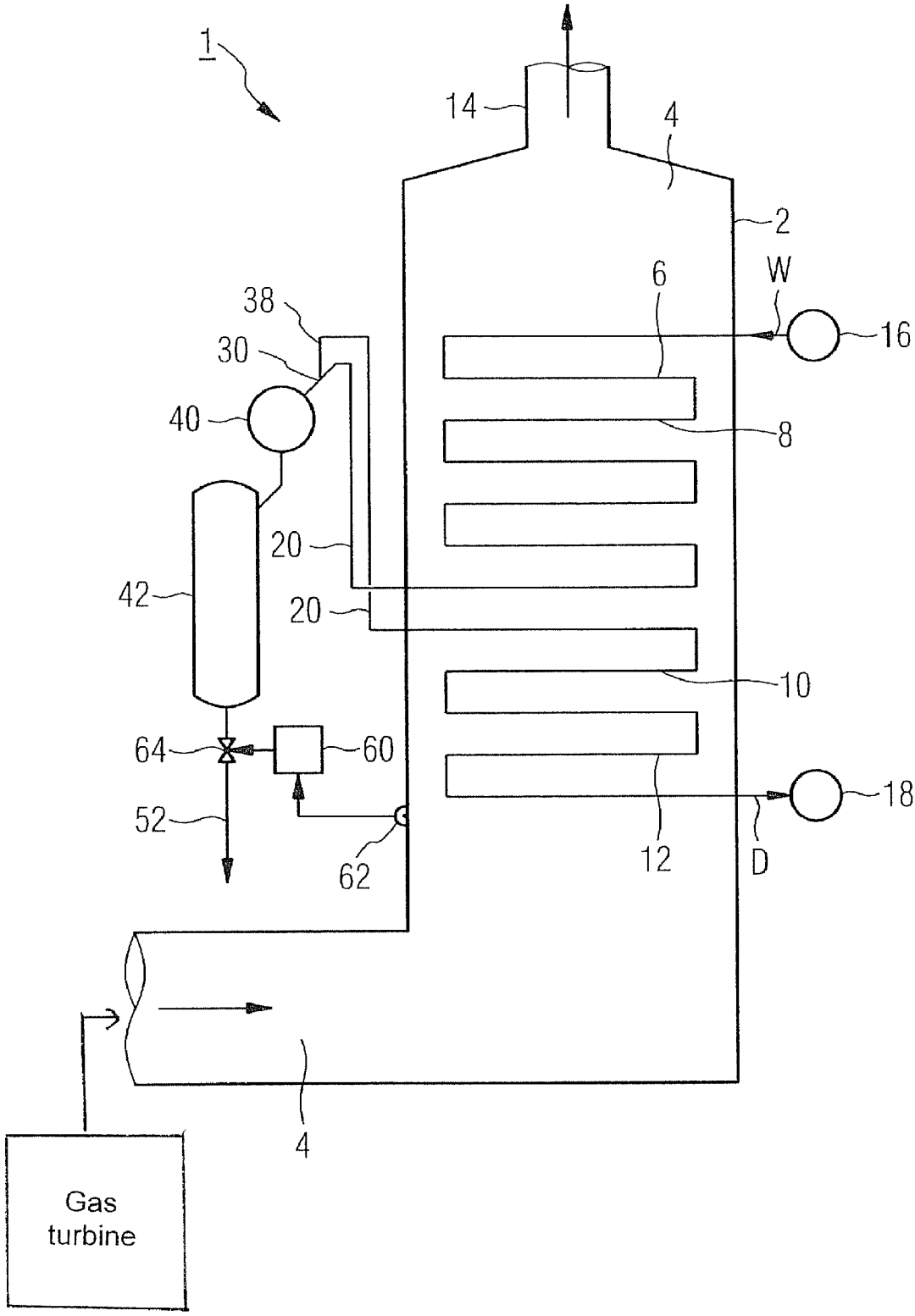
FIG. 1 diagrammatically depicts a vertical steam generator.

The steam generator 1 shown in FIG. 1 is designed as a once-through steam generator and, as part of a combined-cycle gas and steam turbine installation, is connected, in the form of a heat recovery steam generator, downstream of a gas turbine (not shown in more detail) on the exhaust gas side. The steam generator 1 has a boundary wall 2 which forms a heating gas passage 4 for the exhaust gas from the gas turbine. An evaporator once-through heating surface 8, formed from a number of evaporator tubes 6, and a superheater heating surface 12, which is connected downstream of the evaporator once-through heating surface 8 for the flow of a flow medium W, D and is formed from a number of superheater tubes 10, are arranged in the heating gas passage 4. In terms of the routing of the exhaust-gas stream from the gas turbine, the superheater heating surface 12 is arranged upstream of the evaporator once-through heating surface 8, with the result that the exhaust gas from the gas turbine acts first of all on the superheater heating surface 12.

In the exemplary embodiment, the steam generator 1 is of vertical design, in which case the exhaust gas from the gas turbine flows through the heating gas passage 4 in a substantially vertical direction from the bottom upward in the region of the evaporator once-through heating surface 8 and the superheater heating surface 12, with the heating gas passage 4 ending at its upper end in a stack 14. The evaporator tubes 6 and the superheater tubes 10 are laid alternately, in the form of tube coils, with a horizontal orientation in the heating gas passage 4. Alternatively, however, the steam generator 1 could also be of horizontal design for a substantially horizontally routed flue-gas flow in the heating gas passage 4, preferably with alternately vertically oriented tube coils.

The entry ends of the evaporator tubes 6 of the evaporator once-through heating surface 8 are connected to an entry manifold 16. By contrast, the exit side of the superheater tubes 10 is connected to an exit manifold 18. If necessary, it is also possible for further heating surfaces, for example an economizer, preheater and/or convective superheater heating surfaces, to be arranged in the heating gas passage 4.

For the evaporator once-through heating surface 8 and the superheater heating surface 12 to be connected in series on the flow medium side, the evaporator tubes 6 are connected to the superheater tubes 10 via overflow tube sections 20. In the exemplary embodiment, each evaporator tube 6 is connected to in each case one superheater tube 10 via in each case one overflow tube section 20 in a one-to-one association. Alternatively, however, it is also possible to provide for them to be connected up in groups, in which case one or more evaporator tubes 6 are connected to one or more superheater tubes 10 via in each case one overflow tube section 20.

The once-through stream generator 1 is designed to ensure that even in start-up or low-load operation, during which a further recirculated mass flow of flow medium W is superimposed on the evaporator tube 6 in addition to the evaporable mass flow of flow medium W for reasons of operational reliability, the position of the evaporation end point can be kept variable, to allow particularly high operating flexibility. For this purpose, the evaporation end point in start-up and low-load operation, during which for design reasons the flow medium has not yet been completely evaporated at the end of the evaporator tube 6, should be shifted into the superheater tubes 10. To achieve this, the overflow tube sections 20 are provided with an integrated water separation function. For this purpose, a water separation element 30 is in each case integrated in each overflow tube section 20. This in particular also ensures that a complex distribution of water-steam mixture W, D between the superheater tubes 10 is not required after the water-steam separation.

In the exemplary embodiment, the water separation elements 30, only one of which can be seen in FIG. 1, however, are designed in such a manner that each evaporator tube 6 is connected to precisely one subsequent superheater tube 10 in a one-to-one association, so that in functional and circuit-connection terms the water separation is displaced into the individual tubes. This ensures that, in connection with the water-steam separation, neither collection of flow medium flowing out of the evaporator tubes 6 nor distribution of the flow medium flowing onward between the downstream superheater tubes 10 is required. This allows the evaporation end point to be shifted into the superheater tubes 10 in a particularly simple way. However, it has emerged that sufficiently uniform or evenly distributed transfer of water-steam mixture to the superheater tubes 10 is possible even with distribution to no more than approximately ten superheater tubes 10.

Figure 2:
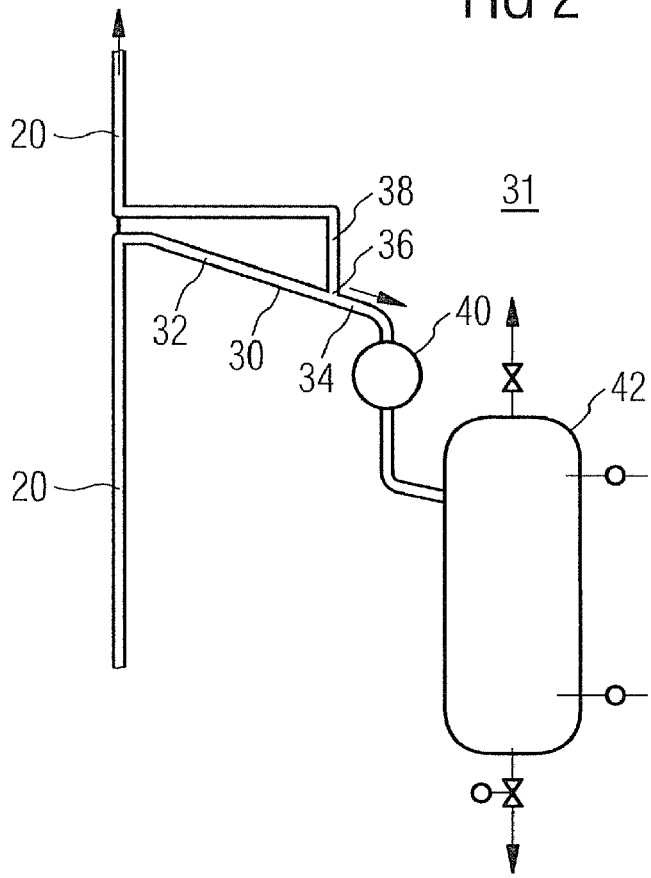
FIG. 2 shows parts of a water separation system of the once-through steam generator illustrated in FIG. 1, and FIG. 3A-3D each show a water separation element.

The water separation system 31, formed by the water separation element 30 and additional components, of the steam generator 1, parts of which are shown again on a larger scale in FIG. 2, therefore comprises a number of water separation elements 30 which corresponds to the number of evaporator tubes 6 and superheater tubes 10; each of these water separation elements 30 is designed in the form of a T tube piece. For this purpose, the respective water separation element 30 comprises an inflow tube piece 32 which is connected to the upstream evaporator tube 6 and, as seen in its longitudinal direction, merges into a water discharge tube section 34, an outflow tube section 38, which is connected to the downstream superheater tube 10, branching off in the transition region 36. This design means that the water separation element 30 is configured for inertial separation of the water/steam mixture which flows into the inflow tube section 32 from the upstream evaporator tube 6. Specifically, on account of its in relative terms higher inertia, the water fraction of the flow medium flowing within the inflow tube section 32 preferentially continues to flow straight on in the axial extension of the inflow tube section 32 at the transition location 36, with the result that it passes into the water discharge tube section 34. By contrast, the steam fraction of the water/steam mixture flowing within the inflow tube section 32, on account of its in relative terms lower inertia, is better able to follow an imposed diversion and therefore flows via the outflow tube section 38 and the overflow tube section 20 to the downstream superheater tube 10.

On the water outlet side, i.e. via the water discharge tube sections 34, the water separation elements 30 are connected in groups to in each case one common exit manifold 40, although it is also possible to provide a plurality of the exit manifolds 40 in groups. For their part, the exit manifolds 40 are connected on the outlet side to a common water collection vessel 42, in particular a separation cylinder.

Figure 3A:
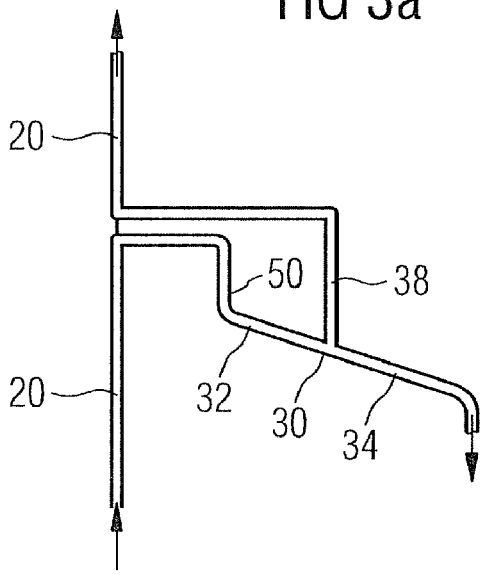

The water separation elements 30 which are designed as T-tube sections, can be of optimized design in terms of their separation action. Suitable exemplary embodiments can be seen in FIG. 3A to 3D. As illustrated in FIG. 3A, the inflow tube section 32, together with the water discharge tube section 34 which follows it, can be of substantially rectilinear design with its longitudinal direction inclined with respect to the horizontal. In the exemplary embodiment shown in FIG. 3A, moreover, a bent tube piece 50 is also connected upstream of the inflow tube piece 32 in a knee shape; on account of its bend and its spatial arrangement, this tube section 50 forces the water which flows into the inflow tube section 32 to be preferentially forced under centrifugal force onto the inner wall side, lying opposite the outflow tube section 38, of the inflow tube section 32 and water discharge tube section 34. This promotes transport of the water fraction onward into the water discharge tube section 34, thereby boosting the overall separation action.

Figure 3B:
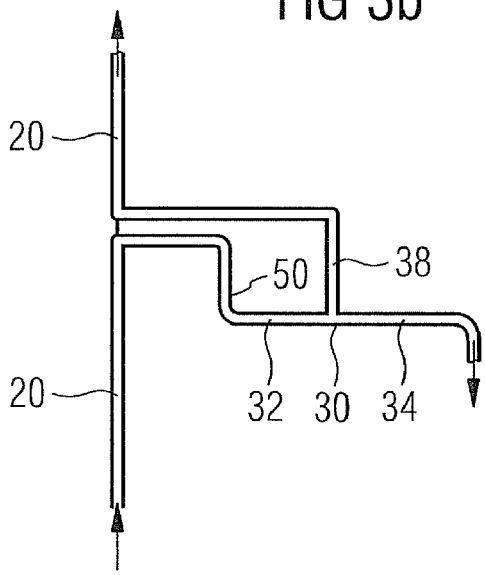

A similar boost to the separation action can also be achieved, if the inflow tube section 32 and water discharge tube section 34 are substantially horizontally oriented, as shown in FIG. 3B, by a suitably bent tube section 50 likewise being connected upstream.

Figure 3C:
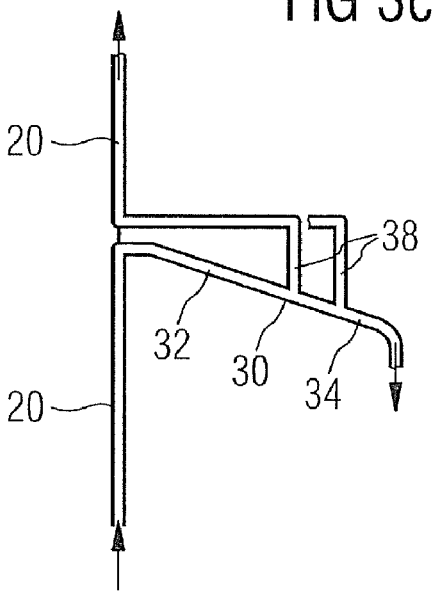
Figure 3D:
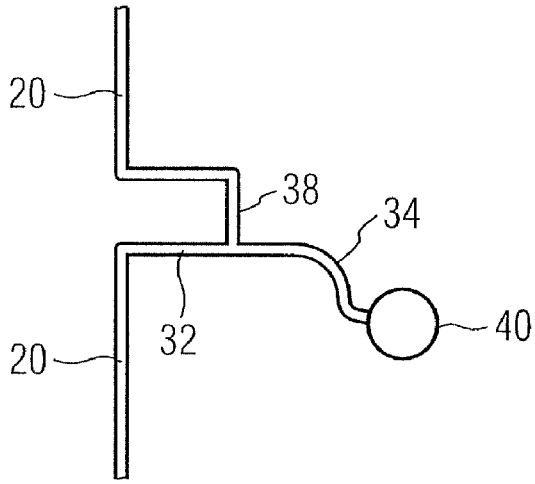

FIG. 3C illustrates an exemplary embodiment in which the water separation element 30 connects a single upstream evaporator tube 6 to a plurality of, in the exemplary embodiment two, superheater tubes 10 connected downstream. For this purpose, in the exemplary embodiment shown in FIG. 3C, two outflow tube sections 38, each of which is connected to in each case one downstream superheater tube 10, branch off from the medium passage formed by the inflow tube section 32 and the water discharge tube section 34. To make it easier for the water which has been separated off to flow into the downstream exit manifold 40, the outflow tube section 34 may—as shown in FIG. 3D—be designed as a downwardly curved tube bend or may comprise a correspondingly configured subsection.

As can be seen from the illustration in FIG. 1, the water collection vessel 42 is connected on the outlet side, via a connected outflow line 52, to a waste water system (not illustrated in more detail). As an alternative or in addition, the outflow line 52 may be connected, directly or via an economizer heating surface which is not illustrated in more detail, to the entry manifold 12 connected upstream of the evaporator tubes 6, resulting in the formation of a closed recirculation circuit, via which an additional circulation can be superimposed on the flow medium flowing in the evaporator tubes 6 in start-up or low-load operation in order to increase operational reliability. Depending on the operating requirements or demands, the separation system 31 can be operated in such a manner that virtually all the water which is still entrained at the exit from the evaporator tubes 6 is separated out of the flow medium and substantially only evaporated flow medium is passed on to the superheater tubes 10.

Alternatively, however, the water separation system 31 can also be operated in what is known as the over-fed mode, in which not all the water is separated out of the flow medium, but rather a part-stream of the entrained water is passed on to the superheater tubes 10 together with the steam D. In this operating mode, the evaporation end point shifts into the superheater tubes 10. In the over-fed mode of this type, initially both the water collection vessel 42 and the upstream exit manifold 40 are filled completely with water, so that a build up of water forms back to the transition region 36 of the respective water separation elements 30, at which the outflow tube section 38 branches off. On account of this build-up of water, the water fraction of the flow medium flowing to the water separation elements 30 is also at least partially diverted and therefore passes into the outflow tube section 38 together with the steam. The level of the part-stream which is fed to the superheater tubes 10 together with the steam results on the one hand from the total mass flow of water fed to the respective water separation element 30 and on the other hand from the partial mass flow which is discharged via the water discharge tube section 34. Therefore, the mass flow of unevaporated flow medium which is passed on to the superheater tubes 10 can be set by suitably varying the mass flow of water supplied and/or the mass flow of water discharged via the water discharge tube section 34. This makes it possible, by controlling one or both of the variables mentioned, to set the proportion of unevaporated flow medium passed on to the superheater tubes 10 in such a manner that, for example, a predetermined enthalpy is established at the end of the superheater heating surface 12.

To allow this to occur, the water separation system 31 is assigned a control device 60 which on the input side is connected to a measurement sensor 62 designed to determine a value which is characteristic of the enthalpy at the flue-gas end of the superheater heating surface 12. On the output side, the control device 60 on the one hand acts on a control valve 64 connected into the outflow line 52 of the water collection vessel 42. Therefore, by targeted actuation of the control valve 64, it is possible to predetermine the flow of water which is removed from the separation system 31. This mass flow can in turn be removed from the flow medium in the water separation elements 30 and passed on to the subsequent collection systems. Consequently, by actuating the control valve 64 it is possible to influence the flow of water which is in each case branched off in the water separation element 30 and therefore to influence the water fraction which, following the separation, is still in the flow medium and is passed on to the superheater heating surfaces 10. As an alternative or in addition, the regulating device 60 can also act on a recirculation pump, so that the inflow rate of the medium into the water separation system 31 can also be set accordingly.

The invention claimed is:

1. A steam generator, comprising:

an evaporator once-through heating surface formed from a plurality of evaporator tubes;

a superheater heating surface arranged in a heating gas side of a heating gas passage and faulted from a plurality of superheater tubes connected downstream of the evaporator tubes with respect to a flow medium;

a plurality of water separation elements each attached to an overflow tube section that connects the evaporator tubes to the superheater tubes with respect to a flow medium, wherein the water separator element comprises an inflow tube section connected to the evaporator tubes which are connected upstream of the water separator element and the inflow tube section, as seen in its longitudinal direction, merges into a water discharge tube section, and wherein the water separator element also comprises a plurality of outflow tube sections, connected to the superheater tubes which are connected downstream of the water separator element, branching off in a transition region between the inflow tube section and the outflow tube section.

2. The steam generator as claimed in claim 1, wherein a medium flows from above to the inflow tube section via a tube bend.

3. The steam generator as claimed in claim 1, wherein in the transition region the water discharge tube section is arranged with a longitudinal direction inclined downward in the direction of flow with respect to the horizontal direction.

4. The steam generator as claimed in claim 1, wherein the water discharge tube section has a downwardly curved tube bend in its entry region.

5. The steam generator as claimed in claim 1, wherein the water separation elements on the water outlet side are connected in groups to a plurality of common exit manifolds.

6. The steam generator as claimed in claim 5, wherein a plurality of water collection vessels are connected downstream of the exit manifolds.

7. The steam generator as claimed in claim 6, wherein a control valve actuated by an associated regulating device is connected in an outflow line connected to the water collection vessel, where an input value that is characteristic of the enthalpy of the flow medium at the steam-side exit of the superheater heating surface connected downstream of the water separation system, to be supplied to the regulating device.

8. The steam generator as claimed in claim 7, wherein a recirculation pump assigned to the evaporator tubes is actuated by the regulating device.

9. The steam generator as claimed in claim 1, wherein a gas turbine is connected upstream of the heating gas passage on the heating gas side.

* * * * *

UNITED STATES PATENT AND TRADEMARK OFFICE

CERTIFICATE OF CORRECTION

PATENT NO. : 8,297,236 B2
APPLICATION NO. : 11/887859
DATED : October 30, 2012
INVENTOR(S) : Joachim Franke and Rudolf Kral It is certified that error appears in the above-identified patent and that said Letters Patent is hereby corrected as shown below:

Col. 9, line 27, remove [faulted] and insert --formed--

Signed and Sealed this
Nineteenth Day of February, 2013

Teresa Stanek Rea

Teresa Stanek Rea
*Acting Director of the United States Patent and Trademark Office*